US006113075A

United States Patent [19]

McMichael et al.

[11] Patent Number: 6,113,075

[45] Date of Patent: Sep. 5, 2000

[54] SCISSORS TYPE APPARATUS FOR REMOVING FLOOR COVERINGS

[76] Inventors: Thomas James McMichael, 8529 Grave Ave.; Timothy Leon Hurlburt, 9606 Polar St., both of Newport Richey, Fla. 34654

[21] Appl. No.: 09/397,980

[22] Filed: Sep. 16, 1999

Related U.S. Application Data

[60] Provisional application No. 60/142,378, Jul. 6, 1999.

[51] Int. Cl.[7] ..... B25B 25/00

[52] U.S. Cl. ..... 254/203; 254/209; 156/344; 299/37.1

[58] Field of Search ..... 254/199, 200, 254/202, 203, 208, 209, 210, 211, 212; 156/344, 584, 247; 299/76.1, 37.1

[56] References Cited

U.S. PATENT DOCUMENTS

| | | | |
|---|---|---|---|
| 3,074,090 | 1/1963 | Thompson | 299/37.1 |
| 4,394,052 | 7/1983 | Adams et al. | 156/344 |
| 4,947,451 | 8/1990 | Foltz | 156/344 |
| 5,254,201 | 10/1993 | Konda et al. | 156/344 |
| 5,415,725 | 5/1995 | Scharf | 156/584 |
| 5,720,844 | 2/1998 | Hanson | 156/344 |
| 5,891,298 | 4/1999 | Kuroda et al. | 156/344 |
| 6,004,426 | 12/1999 | Johnson | 156/344 |

*Primary Examiner*—Donald P. Walsh
*Assistant Examiner*—Emmanuel M. Marcelo

[57] ABSTRACT

A powered apparatus for removing floor coverings includes two frames which are interconnected in a scissor-type manner. Each of the frames supports one or more wheels which are secured at the outer ends of the frames. Thus, the wheels are adapted to be brought into contact in a vertical configuration. Furthermore, at least one of the wheels is driven. Also disclosed is a method of using the device of the present invention.

7 Claims, 3 Drawing Sheets

FIG 1
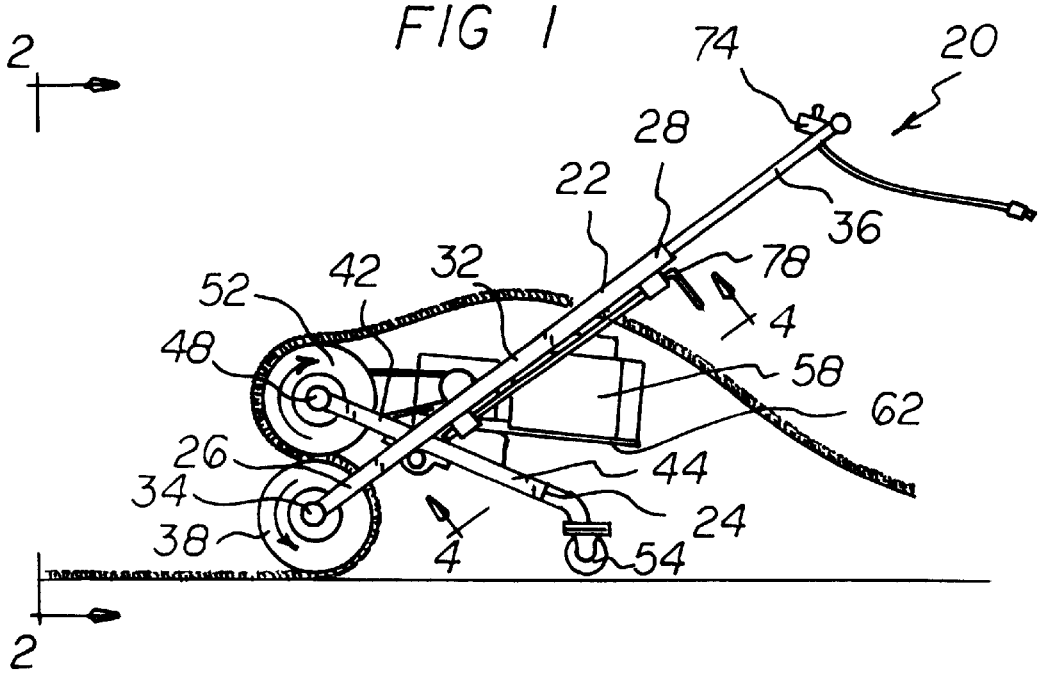
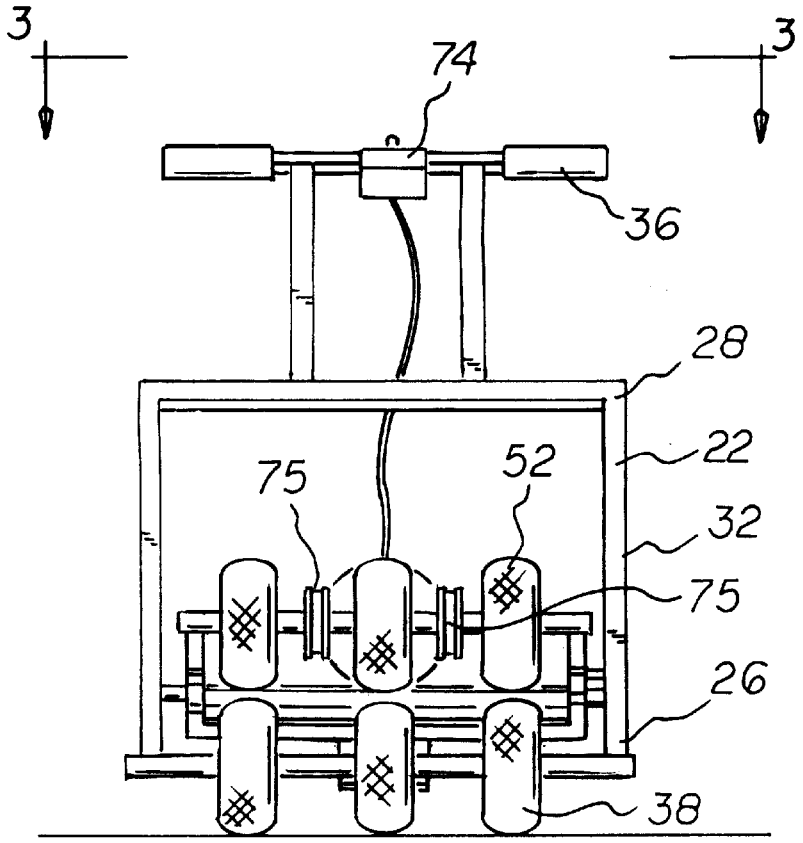
FIG 2

SCISSORS TYPE APPARATUS FOR REMOVING FLOOR COVERINGS

APPLICATION FOR UNITED STATES LETTERS PATENT RELATED APPLICATION DATA

This application claims benefit of pending provisional application 60/142,378 filed Jul. 6, 1999.

BACKGROUND OF THE INVENTION

1. Field of the Invention

The present invention relates to an apparatus for removing floor coverings, and more particularly pertains to such an apparatus which employs a scissors-type action.

2. Description of Related Art

Floor coverings are traditionally removed by hand. This is typically done by scraping beneath the covering and pulling. The tremendous strength of today's industrial adhesives, however, makes this exceptionally difficult work. There are various mechanical devices which give users an increased mechanical advantage.

For example, U.S. Pat. No. 5,720,844 to Hanson discloses a floor covering removal apparatus which employs interlocking gears.

U.S. Pat. No. 5,505,433 to Carmichael et al. discloses a sheet removal apparatus which is adapted to be anchored to the floor.

U.S. Pat. No. 5,415,725 discloses a device for removing glued down carpet employing a pair of leverage arms.

U.S. Pat. No. 4,948,451 to Foltz discloses an automatic carpet stripping apparatus which includes rollers for receiving a lose end of carpet.

Lastly, U.S. Pat. No. 4,394,052 to Adams et al. discloses a carpet take up device utilizing a forward blade.

Although the above described devices may satisfy certain defined objectives, none of them contemplates employing a scissors-type mechanism for the purpose of removing floor coverings.

BRIEF SUMMARY OF THE INVENTION

The general purpose of the present invention is to provide an apparatus for removing floor coverings which utilizes the mechanical advantage inherent in a scissors-type mechanism.

To attain this, the present invention essentially comprises an apparatus for pulling up floor coverings. The apparatus includes a first frame having upper and lower ends and a transverse axle interconnected to the lower end. The apparatus further includes a lower wheel mounted upon the transverse axle. A second frame is included and is defined by upper and lower extents. A transverse axle is interconnected to the upper extent of the second frame. The first and second frame are pivotally interconnected. An upper wheel is mounted upon the transverse axle of the second frame. Lastly, a motor is included for driving the wheels of the apparatus.

It is therefore an object of the present invention to provide a walk behind apparatus for removing floor coverings.

It is another object of the present invention to enable a single user to pull up floor coverings without exerting undue effort.

It is a further object of the present invention to utilize the mechanical advantage present within a scissors mechanism for the purpose of removing floor coverings.

An even further object of the present invention is to allow users to remove floor coverings without the use of solvents.

Even still another object of the present invention is to provide a method to pull up a carpet and lay it back down again.

Lastly, it is an object of the present invention to provide a powered apparatus for pulling up floor coverings. A major wheel frame is included and is defined by a lower end, an upper end and an intermediate extent therebetween. A transverse axle spans the lower end, and a handle is integral to the upper end. Three spaced lower wheels are mounted upon the transverse axle. A minor wheel frame is included and is defined by an upper extent, a lower extent and an intermediate extent therebetween. A transverse axle spans the upper extent, and a trailing wheel is interconnected to the lower extent. An engine mount is secured to the minor wheel frame. The intermediate extents of the major and minor frames are pivotally interconnected. Additionally, three spaced upper wheels are mounted upon the transverse axle of the minor frame, the three wheels being in alignment with the three wheels of the major frame. Additionally, an electric motor is secured to the engine mount, the motor having first and second power take off elements extending from the motor. A first drive belt is positioned about the first power take off and the axle of the minor frame; also, a second drive belt is positioned about the second power take off and the axle of the minor frame. A control panel is secured to the handle and is in electric communication with the electric motor. A frame prop is rotatably secured along a side of the major frame. The prop has a lower end in selective engagement with the minor wheel frame. The prop has a first engaged orientation wherein the frames are locked with respect to one another, and a second orientation which allows the frames to pivot relative to one another.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein:

FIG. 1 is a side elevational view of the apparatus removing carpet.

FIG. 2 is a view taken along line 2—2 of FIG. 1.

The same reference numerals refer to the same parts throughout the various Figures.

DETAILED DESCRIPTION OF THE INVENTION

The present invention relates to a powered apparatus for removing floor coverings. The apparatus includes two frames which are interconnected in a scissor-type manner. Each of the frames supports one or more wheels which are secured at the outer ends of the frames. Thus, the wheels are adapted to be brought into contact in a vertical configuration. Furthermore, at least one of the wheels is driven. The present invention also relates to a method of using the device.

The apparatus 20 includes a first, or major, wheel frame 22 and a second, or minor, wheel frame 24. Together these frames achieve the scissors-type action of the apparatus 20.

Figure 5:
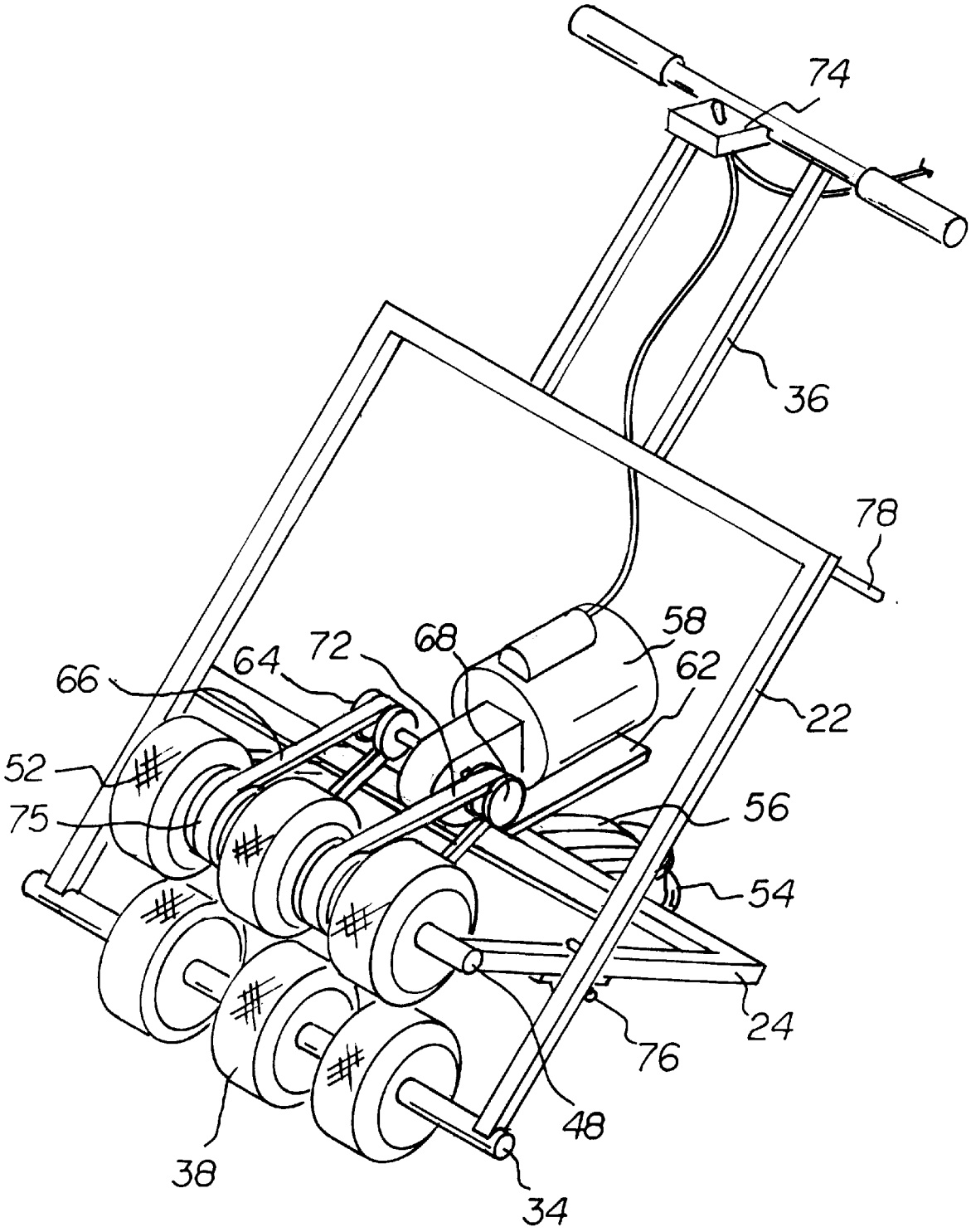
FIG. 5 is a perspective view of the apparatus.

The major wheel frame 22 is defined by a lower extent 26, an upper extent 28 and an intermediate extent 32 therebetween. As illustrated in FIG. 5, the major frame 22 is preferably rectangular in shape and formed primarily from tubing, rectangular or tubular in cross section. Additionally, a transverse axle 34 spans the lower end. Operator control over the apparatus 20 is achieved by a handle 36 which is integrally formed at the upper end of the frame 22.

With continuing reference to FIG. 5, the wheels 38 of the major frame 22 are depicted. Preferably, three wheels 38 are mounted in spaced relation along the transverse axle 34. Although the preferred embodiment describes three wheels any other number could suffice. Furthermore, the preferred embodiment contemplates that the wheels are small pneumatic tires.

As with the major frame 22, the minor wheel frame 24 is defined by an upper extent 42, a lower extent 44 and an intermediate extent 46 therebetween. The minor frame 24 is also rectangular in shape and formed primarily of rectangular tubing. A transverse axle 48 spans the upper extent 42 of the frame for supporting one or more wheels 52. With reference to FIG. 1, the trailing wheel 54 of the apparatus 20 is depicted. The trailing wheel 54 is interconnected to the lower extent 44 of the minor frame 24. Two trailing wheels may also be employed if desired. More specifically, a smaller sub frame 56 is integrally formed at the lower extent 44 of the minor frame 24. This sub frame 56, in turn, rotatably supports the trailing wheel 54. Thus, as is evident from FIG. 1, the apparatus 20 is supported by the wheels 38 of the major frame 22 and the trailing wheel 54.

FIG. 5 illustrates the three spaced upper wheels 52 mounted upon the transverse axle 48 of the minor frame 24. Although three wheels 52 have been described in conjunction with the preferred embodiment, any other number could be readily employed. The preferred embodiment also contemplates that the three wheels 52 of the minor frame 24 are in alignment with the three wheels 38 of the major frame 22. Consequently, when the frames (22 and 24) are brought together, the upper wheels 52 of the minor frame 24 engage the upper surfaces of the lower wheels 38 of the major frame 22.

Figure 3:
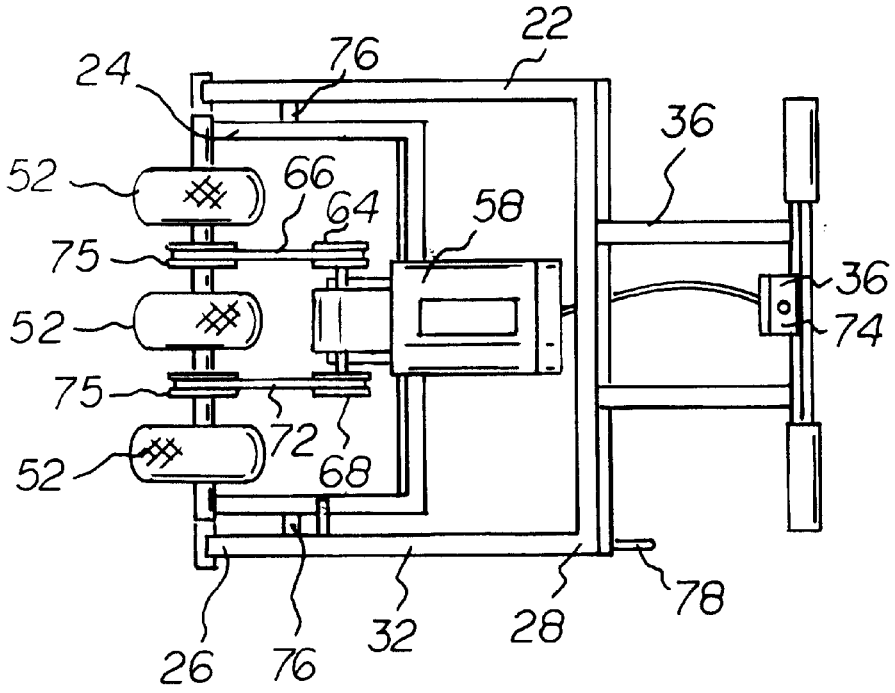
FIG. 3 is a top plan view of the apparatus.

The upper wheels 52 are powered, in the preferred embodiment, via an electric motor 58. Other types of motors are, however, within the scope of the present invention. The motor 58 is secured to an engine mount 62 which is, in turn, supported by the minor frame 24. The motor 58 includes first and second power take off elements, 64 and 68 respectively. These power take off elements are most clearly visible with reference to FIG. 3. A pair of drive belts are interconnected between the power take off elements and the axle 48 of the minor frame 24. Specifically, a first drive belt 66 is positioned about the first power take off 64 and the axle 48 of the minor frame 24. Likewise, the second drive belt 72 is positioned about the second power take off 68 and about the axle 48 of the minor frame 24. Preferably, the belts are interconnected to the axle at locations intermediate the wheels. This interconnection is facilitated by enlarged axle portions 75. Ultimately, this arrangement allows the belts to deliver rotational motion to the wheels 52 of the minor axle 48. Although drive belts have been described, chain and sprocket drives can also be employed. Rotational movement can then be delivered to the wheels 38 of the major frame 22 by bringing the two sets of wheels into contact. Rotational motion can be controlled via a control panel 74 which is in electric communication with the electric motor 58. In the preferred embodiment, the panel 74 is secured to the handle 36.

FIG. 1 illustrates the manner in which the two frames are interconnected. Specifically, the intermediate extents (32 and 46 respectively) of the major and minor frames (22 and 24 respectively) are pivotally interconnected by way of opposing pins 76. Thus, the two frames are interconnected in a scissor-type fashion. As can be appreciated from FIG. 5, exerting downward pressure on the handle 36 results in the two forward extents coming together. This also causes the wheels (38 and 52) to come into contact with each other. The weight of the machine itself causes the wheels to come together. Furthermore, areas where the carpet is especially secured causes even more pressure between the wheels. This, in turn, increases the pulling force applied. Conversely, pulling the handle upwardly results in the forward extents being separated from one another. In use, increased downward force upon the handle 36 increases the pressure between the wheels (38 and 52) of the two frames (22 and 24). This action increases the pulling force generated by the wheels (38 and 52). Such pulling force both separates the covering from the floor and helps propel the apparatus 20 forward.

Figure 4:
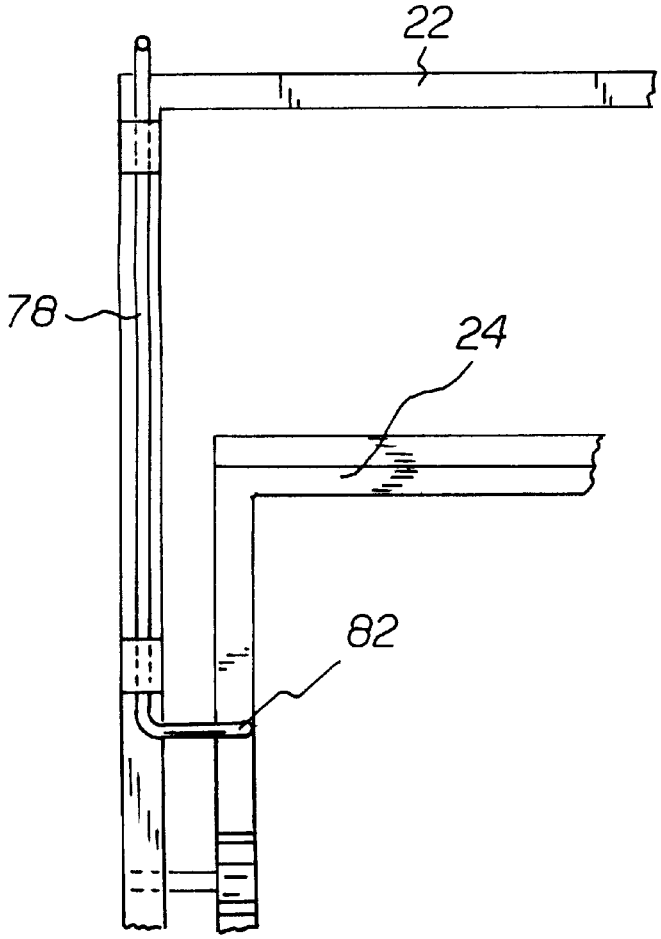
FIG. 4 is a detailed view of the frame prop taken along line 4—4 of FIG. 1.

FIG. 4 illustrates the frame prop 78 which is employed with the apparatus 20. The prop 78 is rotatably secured along a side of the major frame 22 and has a lower end 82 in selective engagement with the minor wheel frame 24. The prop 78 has a first engaged orientation wherein the frames (22 and 24) are locked with respect to one another, and a second orientation allowing the frames (22 and 24) to pivot relative to one another.

The method of employing the apparatus of the present invention will next be described. The method involves providing wheels on a first and second support. The second support is interconnected to the first support, such that the wheels of the first support are below the wheels of the second support. Thereafter, the floor covering is cut into one or more elongated strips in a manner known in the art. Next, a short section of one end of one of the elongated strips is freed. After being freed, the end is fed between the wheels of the first and second supports. More specifically, the floor covering is fed underneath the wheel of the first support and overtop of the wheel of the second support. Thus, when properly threaded, the carpet, or floor covering, takes a reverse S shape, note FIG. 1.

This detailed description has been provided only for illustrative purposes. It is recognized that other embodiments may be articulated without departing from the objects and scope of the present invention. Any such modifications and variations are meant to be within the scope of the invention as contained within the following claims.

What is claimed as being new and desired to be protected by LETTERS PATENT of the United States is as follows:

1. A powered apparatus for pulling up floor coverings comprising:

a major wheel frame having a lower end, an upper end and an intermediate extent therebetween, a transverse axle spanning the lower end, a handle integral to the upper end;

three spaced lower wheels mounted upon the transverse axle;

a minor wheel frame having an upper extent, a lower extent and an intermediate extent therebetween, a transverse axle spanning the upper extent, a trailing wheel interconnected to the lower extent, an engine mount secured to the minor wheel frame, the intermediate extents of the major and minor frame being pivotally interconnected;

three spaced upper wheels mounted upon the transverse axle of the minor frame, the three wheels being in alignment with the three wheels of the major frame;

an electric motor secured to the engine mount, the motor having first and second power take off elements extending from the motor, a first drive belt positioned about the first power take off and the axle of the minor frame, a second drive belt positioned about the second power take off and the axle of the minor frame, a control panel secured to the handle and in electric communication with the electric motor;

a frame prop rotatably secured along a side of the major frame, the prop having a lower end in selective engagement with the minor wheel frame, the prop having a first engaged orientation wherein the frames are locked with respect to one another, and a second orientation allowing the frames to pivot relative to one another.

2. An apparatus for pulling up floor coverings comprising:

a first frame having upper and lower ends and a transverse axle interconnected to the lower end;

a lower wheel mounted upon the transverse axle;

a second frame having upper and lower extents, a transverse axle interconnected to the upper extent, the first and second frames being pivotally interconnected;

an upper wheel mounted upon the transverse axle of the second frame;

a motor for driving one of the wheels of the apparatus.

3. The apparatus as described in claim 2 wherein three spaced wheels are mounted upon the axle of the first frame, and three spaced wheels are mounted upon the axle of the second frame.

4. The apparatus as described in claim 2 wherein a trailing wheels is interconnected to the lower extent of the second frame.

5. The apparatus as described in claim 2 wherein the first and second frames are interconnected at their intermediate extents and pivot relative to one another in a scissors-type manner.

6. A method of pulling up floor coverings comprising the steps of:

providing a wheel supported upon a first support;

providing a wheel supported upon a second support which is pivotally interconnected to the first support, such that the wheels of the first support are below the wheels of the second support;

cutting the floor covering into one or more elongated strips;

freeing a short section of one end of one of the elongated strips;

feeding the freed end between the wheels of the first and second supports.

7. The method as described in claim 6 wherein the floor covering is fed underneath the wheel of the first support and overtop of the wheel of the second support.

* * * * *